US010741976B1

(12) United States Patent
Maesoba et al.

(10) Patent No.: US 10,741,976 B1
(45) Date of Patent: Aug. 11, 2020

(54) SHIELD CONNECTOR AND MALE SHIELD TERMINAL

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Hiroyoshi Maesoba, Mie (JP); Toshifumi Ichio, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 16/482,698

(22) PCT Filed: Jan. 12, 2018

(86) PCT No.: PCT/JP2018/000708
§ 371 (c)(1),
(2) Date: Jul. 31, 2019

(87) PCT Pub. No.: WO2018/142883
PCT Pub. Date: Aug. 9, 2018

(30) Foreign Application Priority Data

Feb. 2, 2017 (JP) ..... 2017-017180

(51) Int. Cl.
*H01R 13/659* (2011.01)
*H01R 13/6593* (2011.01)

(52) U.S. Cl.
CPC ..... *H01R 13/6593* (2013.01)

(58) Field of Classification Search
CPC ..... H01R 13/6593
See application file for complete search history.

(56) References Cited

U.S. PATENT DOCUMENTS 6,200,162 B1 * 3/2001 Aoyama ..... H01R 4/184 439/578
6,384,335 B1 * 5/2002 Saito ..... H01R 9/0518 174/74 R (Continued)

FOREIGN PATENT DOCUMENTS

JP 10-172681 6/1998
JP 2000-12165 1/2000

(Continued)

OTHER PUBLICATIONS

International Search Report dated Mar. 13, 2018.

*Primary Examiner* — Ross N Gushi
(74) *Attorney, Agent, or Firm* — Gerald E. Hespos; Michael J. Porco; Matthew T. Hespos

(57) ABSTRACT

A shield connector includes a male shield terminal (20) mounted in a male housing (10), male inner conductors (37) constituting the male shield terminal (20) and to be connected to female inner conductors (78) by connecting both housings (10, 70), a male outer conductor (21) surrounding the male inner conductors (37) via a male dielectric (31) and configured to contact a female outer conductor (76) by connecting the both housings (10, 70), a tube (25) formed in the male outer conductor (21) and surrounding the female outer conductor (76) with the housings (10, 70) connected, and resilient contact pieces (26) formed in the male outer conductor (21) and to be resiliently connected to an outer periphery of the female outer conductor (76). The tube (25) is continuous over an entire periphery, thereby restricting an expanding deformation thereof.

4 Claims, 13 Drawing Sheets

(56) References Cited

U.S. PATENT DOCUMENTS 6,554,623 B2 * 4/2003 Yoshioka ..... H01R 13/6592 439/98
6,709,290 B2 * 3/2004 Yoshida ..... H01R 9/0518 439/585
6,749,464 B2 * 6/2004 Obata ..... H01R 13/6582 439/578
6,808,417 B2 * 10/2004 Yoshida ..... H01R 9/0518 439/585
6,887,106 B2 * 5/2005 Noguchi ..... H01R 13/6582 439/607.56
7,204,716 B1 * 4/2007 George ..... H01R 13/5205 439/275
7,635,282 B2 * 12/2009 Sakamoto ..... H01R 4/184 439/578
7,980,894 B1 * 7/2011 Hall ..... H01R 9/053 439/585
8,366,483 B2 * 2/2013 Hardy ..... H01R 9/0518 439/578
8,777,665 B2 * 7/2014 Il ..... H01R 13/6593 439/607.27
8,870,596 B2 * 10/2014 Ii ..... H01R 13/6581 439/607.41
8,926,368 B2 * 1/2015 Il ..... H01R 13/658 439/607.5
9,033,733 B2 * 5/2015 Takahashi ..... H01R 4/185 439/585
9,531,132 B2 * 12/2016 Iwamoto ..... H01R 13/6581
9,537,231 B2 * 1/2017 Hall ..... H01R 9/0518
9,673,568 B2 * 6/2017 Tanaka ..... H01R 13/6581
9,673,578 B1 * 6/2017 Lane ..... H01R 13/631
9,787,017 B1 * 10/2017 Lane ..... H01R 9/05
9,929,519 B1 * 3/2018 Hall ..... H01R 13/405
9,960,550 B2 * 5/2018 Ensley ..... H01R 13/424
10,355,463 B2 * 7/2019 Inoue ..... H01R 9/0524
10,439,339 B2 * 10/2019 Motohashi ..... H01R 24/38
10,468,786 B2 * 11/2019 De Cloet ..... H01R 24/40
10,594,056 B2 * 3/2020 Kanemura ..... H01R 13/6592
10,594,057 B2 * 3/2020 Kanemura ..... H01R 4/20
10,644,414 B2 * 5/2020 Kanemura ..... H01R 9/0518
10,644,416 B2 * 5/2020 Kanemura ..... H01R 13/50
2013/0171872 A1 * 7/2013 Kanda ..... H01R 24/44 439/607.41
2019/0199036 A1 * 6/2019 Kanemura ..... H01R 24/40
2020/0021064 A1 * 1/2020 Maesoba ..... H01R 13/50
2020/0036129 A1 * 1/2020 Maesoba ..... H01R 13/4364
2020/0052445 A1 * 2/2020 Maesoba ..... H01R 9/0518
2020/0136294 A1 * 4/2020 Maesoba ..... H01R 13/42

FOREIGN PATENT DOCUMENTS

JP 2000-299163 10/2000
JP 2010-282895 12/2010
JP 2012-129103 7/2012
JP 2015-524604 8/2015
WO 2015/004122 1/2015

* cited by examiner

SHIELD CONNECTOR AND MALE SHIELD TERMINAL

BACKGROUND

Field of the Invention

The invention relates to a shield connector and a male shield terminal.

Related Art

Japanese Unexamined Patent Publication No. 2012-129103 discloses a connector in which a female outer terminal and a female inner terminal are provided in a female housing, a male outer terminal and a male inner terminal are provided in a male housing and the female inner terminal and the male inner terminal are connected by connecting the female housing and the male housing. In this connector, the female outer terminal and the male outer terminal are connected when the female housing and the male housing are connected. By uniting a semi-cylindrical portion of the female outer terminal and a semi-cylindrical portion of the male outer terminal into a cylindrical shape, contact parts of the female inner terminal and the male inner terminal are shielded over the entire circumference.

Since the female semi-cylindrical portion and the male semi-cylindrical portion merely are united, a shielding function may be reduced due to a clearance formed between the semi-cylindrical portions. As a countermeasure, it is considered to form a resilient contact piece in one semi-cylindrical portion and resiliently bring this resilient contact piece into contact with the mating semi-cylindrical portion. However, the semi-cylindrical portions are shaped to be expandable and deformable radially outward by a resilient force of the resilient contact piece. Thus, contact reliability cannot be enhanced and a reduction of the shielding function cannot be avoided even if the resilient contact piece is formed.

The invention was completed on the basis of the above situation and aims to improve the reliability of a shielding function.

SUMMARY

The invention is directed to a shield connector with a female housing, a female shield terminal mounted in the female housing. The female shield terminal includes a female inner conductor, a female outer conductor surrounding the female inner conductor and a female dielectric between the female outer conductor and the female inner conductor. A male housing is connectable to the female housing, and a male shield terminal is mounted in the male housing. The male shield terminal has a male inner conductor connected to the female inner conductor by connecting the female housing and the male housing. A male outer conductor surrounds the male inner conductor and a male dielectric is between the male outer conductor and the male inner conductor. The male outer conductor contacts the female outer conductor by connecting the female housing and the male housing. A tube is formed in the male outer conductor. The tube surrounds the female outer conductor with the female housing and the male housing connected. A resilient contact piece is formed in at least one of the female outer conductor and the male outer conductor. The resilient contact piece resiliently connects an outer periphery of the female outer conductor and an inner periphery of the tube. The tube is continuous over an entire periphery, thereby restricting an expanding deformation thereof.

The invention also is directed to a male shield terminal to be mounted into a male housing that is connectable to a female housing. The male shield terminal includes a male inner conductor connectable to a female inner conductor provided in the female housing. A male outer conductor surrounds the male inner conductor and a male dielectric is between the male outer conductor and the male inner conductor. The male outer conductor is capable of contacting a female outer conductor provided in the female housing. A tube is formed in the male outer conductor and surrounds the female outer conductor with the female housing and the male housing connected. A resilient contact piece is formed in the male outer conductor. The resilient contact piece is connected resiliently to an outer periphery of the female outer conductor. The tube is continuous over an entire periphery, thereby restricting an expanding deformation thereof.

With the outer periphery of the female outer conductor and the tube of the male outer conductor connected by the resilient contact piece, a resilient force of the resilient contact piece acts in a direction to expand and deform the tube. However, since the tube is continuous over the entire periphery to restrict the expanding deformation thereof, contact reliability between the female outer conductor and the male outer conductor is excellent.

The tube may surround a tab of the male inner conductor. According to this configuration, the tube prevents interference of external matter with the tab when the male shield terminal is detached from the male housing.

The male outer conductor may include a tubular member formed with the tube and a crimping member formed with a crimping portion to be crimped to a shield shell of a cable. According to this configuration, the crimping portion having a complicated shape is formed on the crimping member separate from the tube. Thus, the shape of the tubular member can be simplified. In this way, a function of restricting the expanding deformation of the tube can be prioritized in designing the tubular member, and the expanding deformation of the tube can be prevented reliably.

The female housing may be formed with a contact surface that an outer peripheral surface of the tube contacts with the female housing and the male housing connected. According to this configuration, the expanding deformation of the tube is restricted by the contact surface of the female housing when the female housing and the male housing are connected. Thus, the contact reliability of the female outer conductor and the male outer conductor is improved.

DETAILED DESCRIPTION

Figure 1:
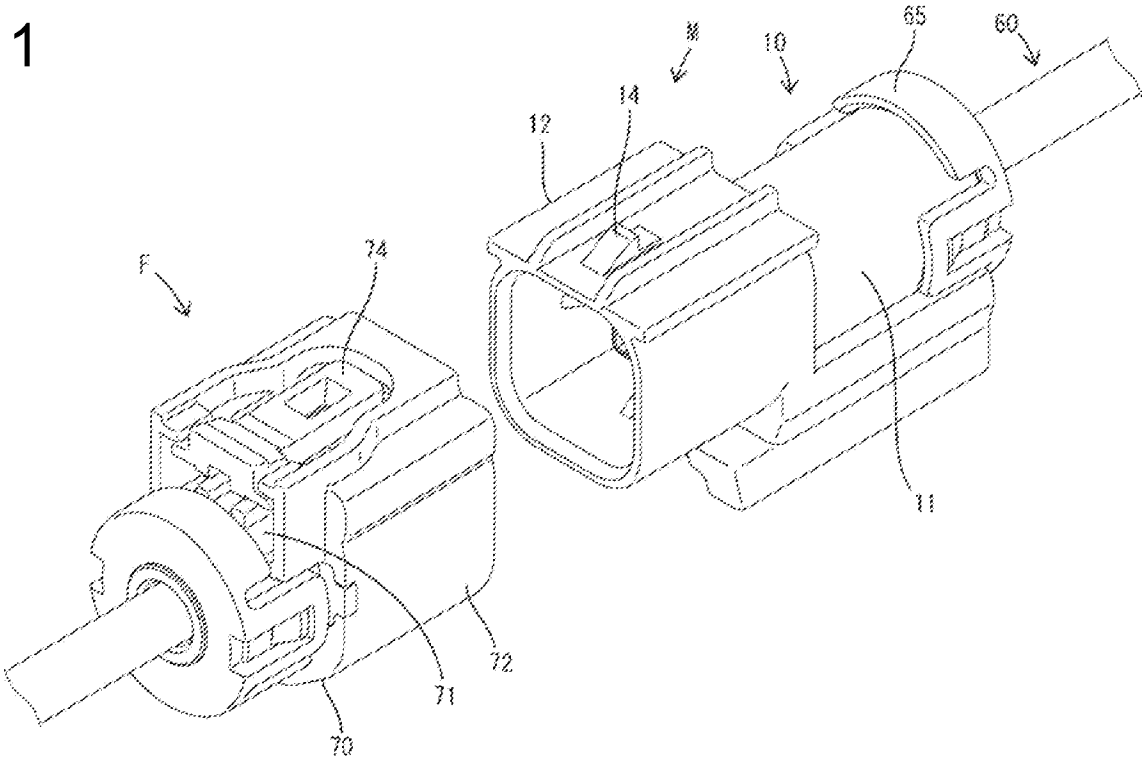
FIG. 1 is a perspective view showing a state where a male connector and a female connector are separated.

One specific embodiment of the invention is described with reference to FIGS. 1 to 13. A shield connector of this embodiment includes a male connector M and a female connector F connectable to each other. Note that, in the following description, a left side in FIGS. 1 to 4 is defined as a front end concerning a front-rear direction of the male connector M. Upper and lower sides shown in FIGS. 1, 2, 4 and 5 are defined as upper and lower sides concerning a vertical direction.

The male connector M includes a male housing 10 made of synthetic resin and a male shield terminal 20. The male housing 10 is formed with a terminal accommodating portion 11 open on both front and rear ends and a receptacle 12 in the form of a rectangular tube extending forward from the terminal accommodating portion 11. A locking lance 13 for retaining the male shield terminal 20 is formed inside the terminal accommodating portion 11, and a lock projection 14 is formed on the outer surface of the receptacle 12.

Figure 5:
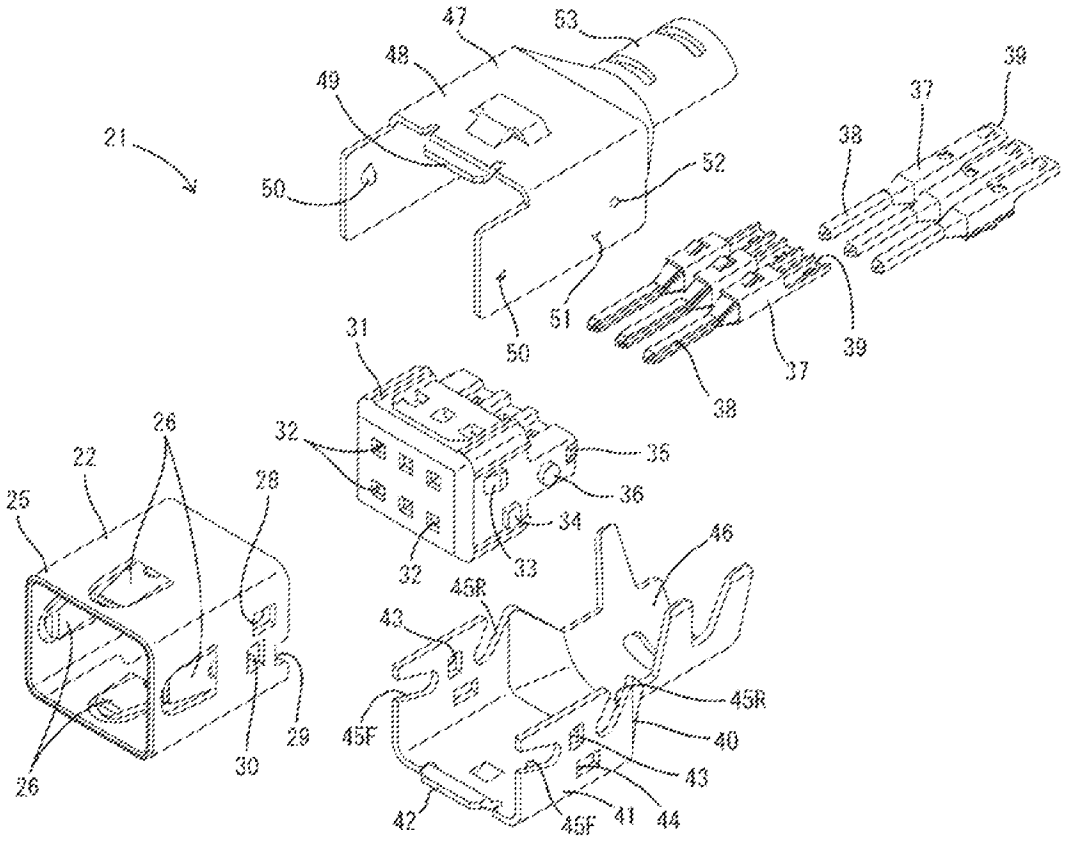
FIG. 5 is a perspective view showing an exploded state of a male shield terminal.

As shown in FIG. 5, the male shield terminal 20 is configured by assembling a male outer conductor 21, a male dielectric 31 and male inner conductors 37. The male outer conductor 21 is configured by assembling three components, i.e. a tubular member 22, a lower member 40 (crimping member as claimed) and an upper member 47.

Figure 6:
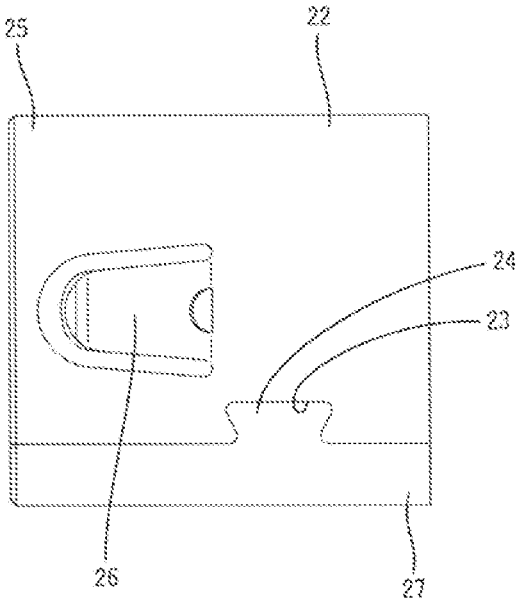
FIG. 6 is a bottom view of a tubular member.

The tubular member 22 is formed into a substantially rectangular tube by bending a single rectangular metal plate substantially at right angles along four fold lines extending in the front-rear direction and applying cutting, raising and the like. As shown in FIG. 6, a substantially trapezoidal (dovetail) recess 23 is formed in one end edge part of the metal plate and a substantially trapezoidal protrusion 24 is formed on the other end edge of the metal plate material. The recess 23 and the protrusion 24 are fit together in a lower part of the tubular member 22 to restrict separation in a circumferential direction (lateral direction) in a lower part constituting the tubular member 22 and to retain the tubular member 22 in a rectangular tube form continuous over the entire periphery in the circumferential direction so as not to expand and deform.

A front area of the tubular member 22 serves as a substantially rectangular tube 25 functioning as a contacting means with a female outer conductor 76. Resilient contact pieces 26 are cut and raised on each of the four plates of the tube 25 and are cantilevered obliquely inward toward the front. These resilient contact pieces 26 resiliently contact the outer peripheral surface of the female outer conductor 76. The resilient contact pieces 26 are disposed in an area forward of the recess 23 and the protrusion 24.

Figure 8:
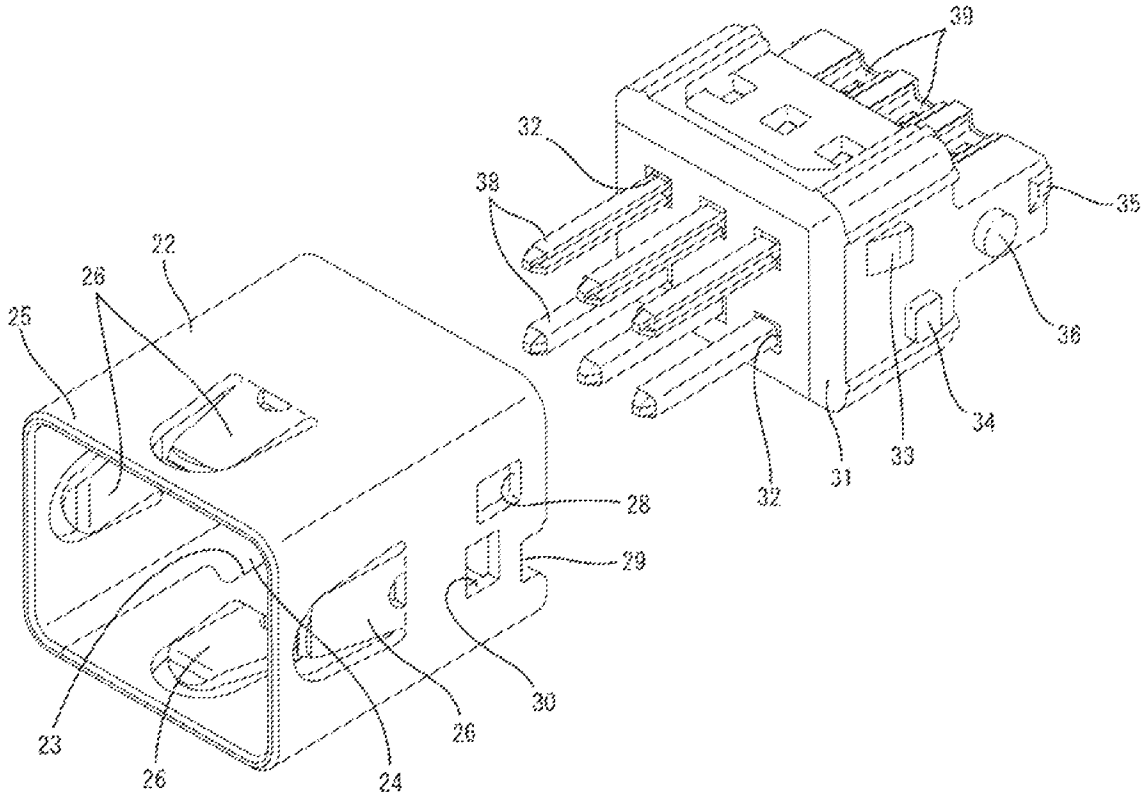
FIG. 8 is a perspective view showing a state where the tubular member and the male dielectric are separated.

A rear end area of the tubular member 22 functions as a holding portion 27 substantially in the form of a rectangular tube for holding the male dielectric 31. As shown in FIGS. 5 and 8, a first locking portion 28 in the form of a window, a second locking portion 29 formed by cutting the rear end edge of the holding portion 27 and a third locking portion 30 in the form of a window are formed in each of the left and right plates constituting the holding portion 27.

The male dielectric 31 is made of synthetic resin and is in the form of a block. Elongated accommodation holes 32 penetrate the male dielectric 31 in the front-rear direction. A first locking projection 33, a second locking projection 34, a fourth locking projection 35 and a first guide pin 36 are formed on each of both left and right side surfaces of the male dielectric 31.

The male inner conductor 37 is made of a metal material and has an elongated shape in the front-rear direction. An elongated tab 38 is cantilevered forward at a front part of the male inner conductor 37, and a wire connecting portion 39 is formed in a rear part of the male inner conductor 37.

The lower member 40 is formed by applying bending and the like to a metal plate material. A front area of the lower member 40 serves as a lower shell 41 in which left and right side plate parts rise from both left and right side edges of a bottom plate. A first fulcrum 42 is formed on the bottom plate of the lower shell 41 and defines a rib projecting along a front edge. The first fulcrum 42 is bent into a step shape in a side view. Each of both left and right side plates of the lower shell 41 is formed with: a first guide groove 45F cut obliquely downward to the rear from the front end edge of the side plate, a fourth locking portion 43 in the form of a window, a fifth locking portion 44 in the form of a window and a second guide groove 45R cut obliquely down to the front from the rear end edge of the side plate. A rear end area of the lower member 40 is an open barrel that serves as a crimping portion 46.

The upper member 47 is formed by applying bending to a metal plate material. A front area of the upper member 47 serves as an upper shell 48 in which left and right side plate parts extend downward from both left and right sides of a top plate. A second fulcrum 49 is formed along a front edge of the top plate of the upper shell 48 and defines a rib bent into a step shape in a side view. Each of the inner surfaces of both left and right side plates of the upper shell 48 is formed with a third locking projection 50, a fifth locking projection 51 and a second guide pin 52. A rear end area of the upper member 47 serves as a cover 53 facing the crimping portion 46 of the lower member 40 from above.

Figure 4:
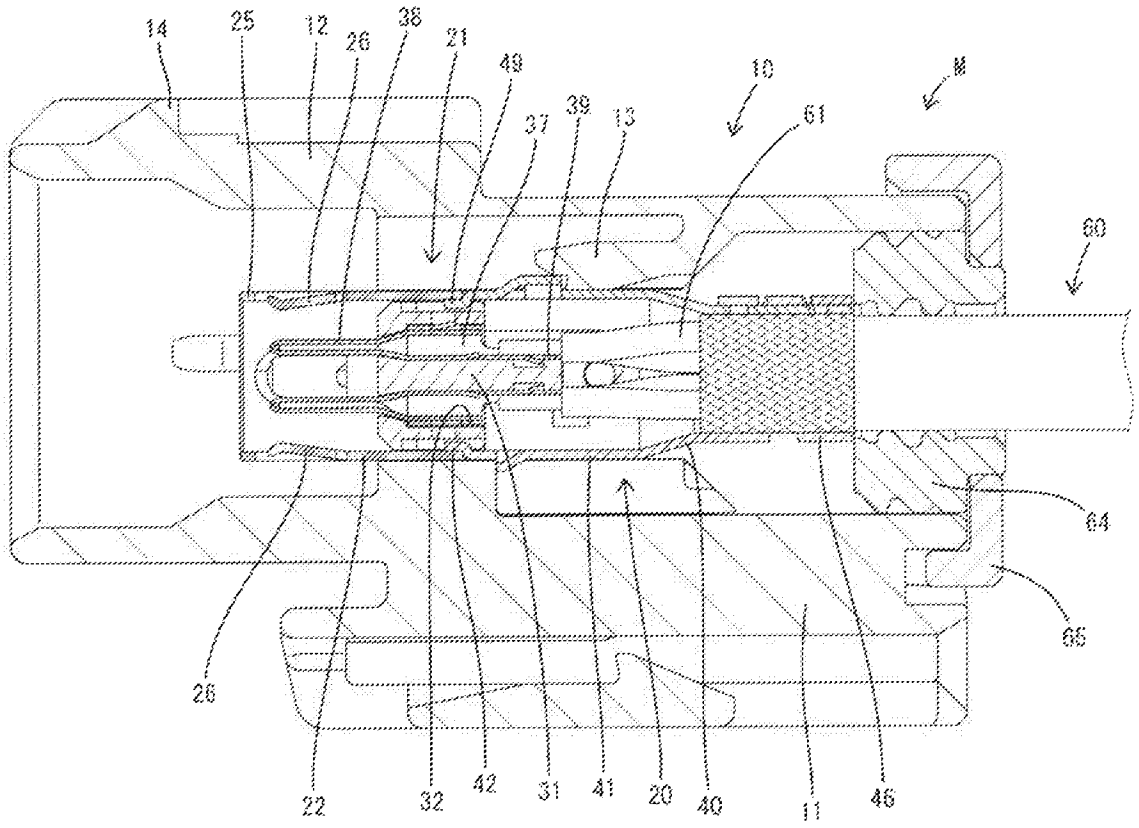
FIG. 4 is a side view in section of the male connector.
Figure 7:
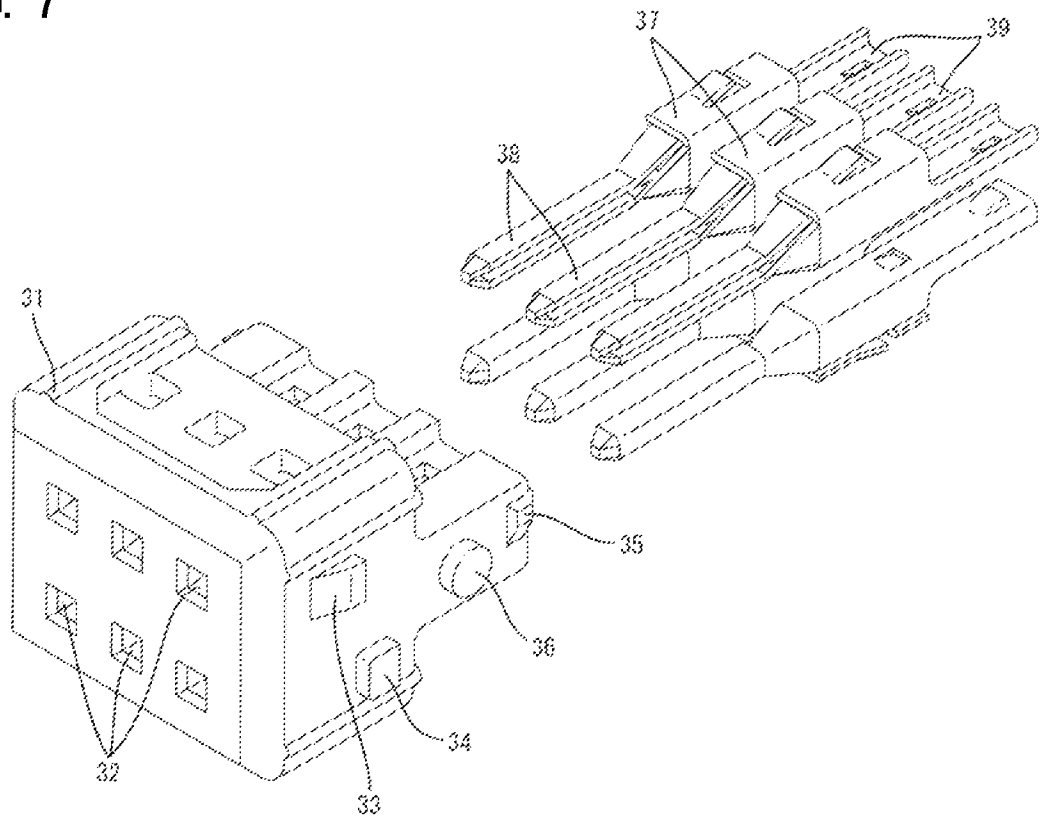
FIG. 7 is a perspective view showing a state where a male dielectric and male inner conductors are separated.

Next, an assembling procedure of the shield connector of this embodiment is described. First, the male inner conductors 37 are inserted into the accommodation holes 32 of the male dielectric 31 from behind, as shown in FIG. 7. With the male inner conductors 37 mounted in the male dielectric 31, the tabs 38 project forward from the front surface of the male dielectric 31 and the wire connecting portions 39 are exposed to the outside from the upper and lower surfaces of the male dielectric 31, as shown in FIGS. 4 and 8.

Figure 9:
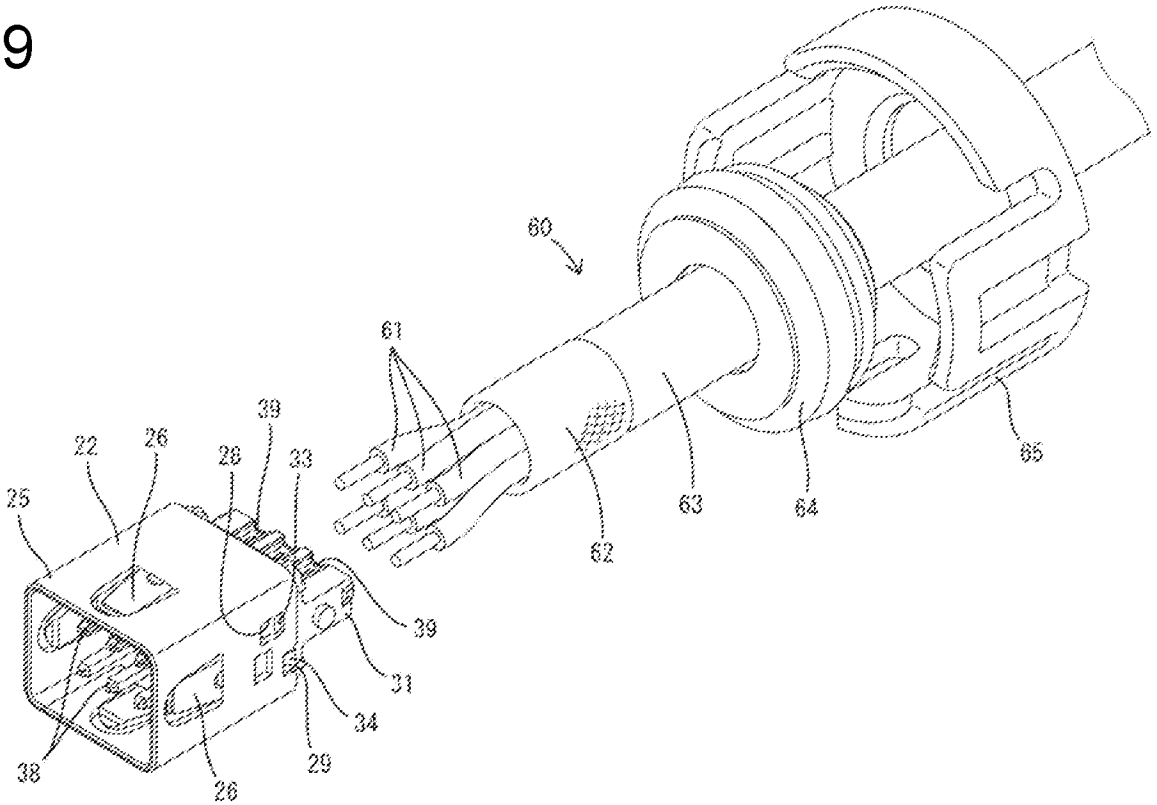
FIG. 9 is a perspective view showing a state before the male inner conductors and coated wires of a multi-core cable are connected.

Subsequently, the male dielectric 31 is assembled with the tubular member 22 from behind. As shown in FIGS. 4 and 9, the front area of the male dielectric 31 is fit in the holding portion 27 of the tubular member 22 and the tabs 38 are surrounded collectively by the tube 25 in a mounted state of the tubular member 22 and the male dielectric 31. Further, the tubular member 22 and the male dielectric 31 are held in an assembled state by locking the first locking projections 33 and the first locking portions 28, and by the locking of the second locking projections 34 and the second locking portions 29. In the mounted state, the fourth locking projections 35, the first guide pins 36 and the wire connecting portions 39 of the male inner conductors 37 are exposed rearwardly of the tubular member 22.

Thereafter, front end parts of coated wires 61 constituting a multi-core cable 60 (cable as claimed) are connected conductively to the respective wire connecting portions 39 of the respective male inner conductors 37 by soldering. The multi-core cable 60 includes the thin coated wires 61, a shield layer 62 formed of a braided wire surrounding the coated wires 61 in a bundled state and a hollow cylindrical sheath 63 surrounding the shield layer 62. A front part of the shield layer 62 is folded rearward to cover the outer periphery of the sheath 63. The coated wires 61 extend forward from the front ends of the sheath 63 and the shield layer 62.

Figure 10:
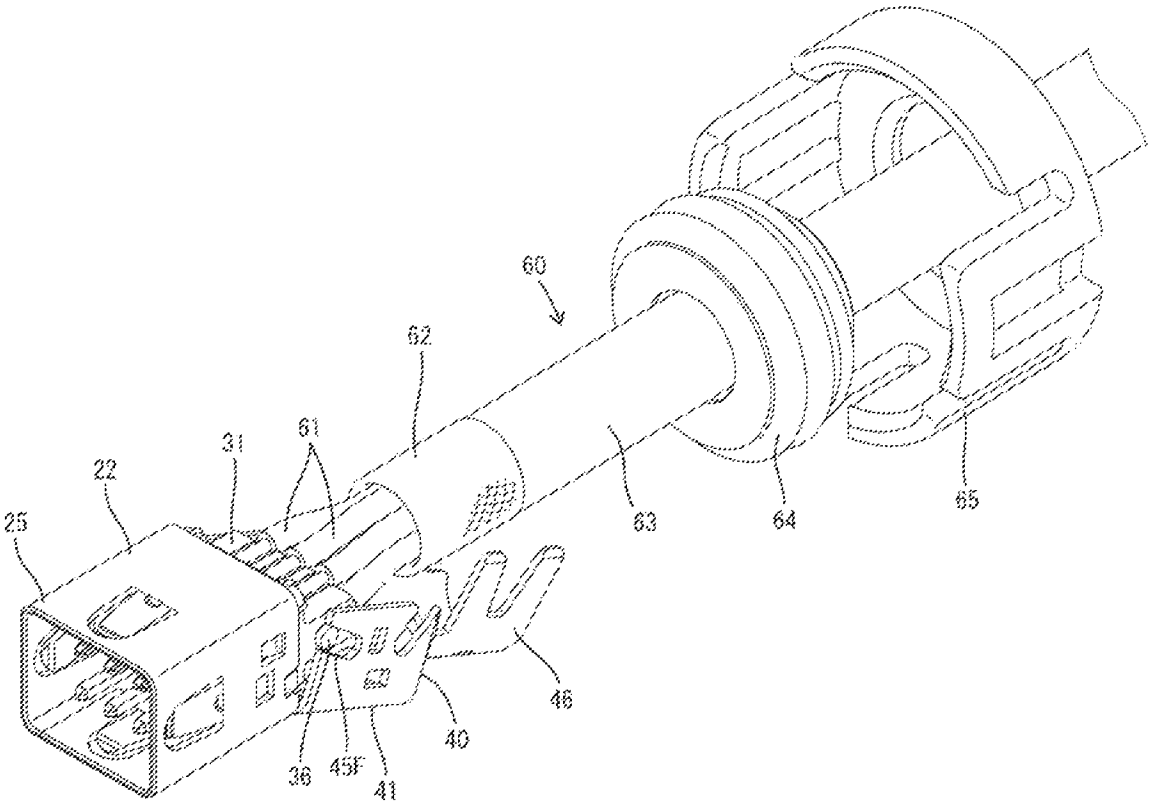
FIG. 10 is a perspective view showing a state where a lower member is being mounted on the tubular member and the male dielectric.

After the coated wires 61 are connected to the wire connecting portions 39, the lower member 40 is assembled with the tubular member 22 and the male dielectric 31. In mounting, the first fulcrum 42 of the lower member 40 is locked to a lower edge of the rear end of the holding portion 27 of the tubular member 22 and the lower member 40 is swung up with the locking position as a fulcrum as shown in FIG. 10. In the process of swinging the lower member 40, the first guide grooves 45F and the first guide pins 36 slide against each other so that a swing trajectory of the lower member 40 is stabilized.

Figure 11:
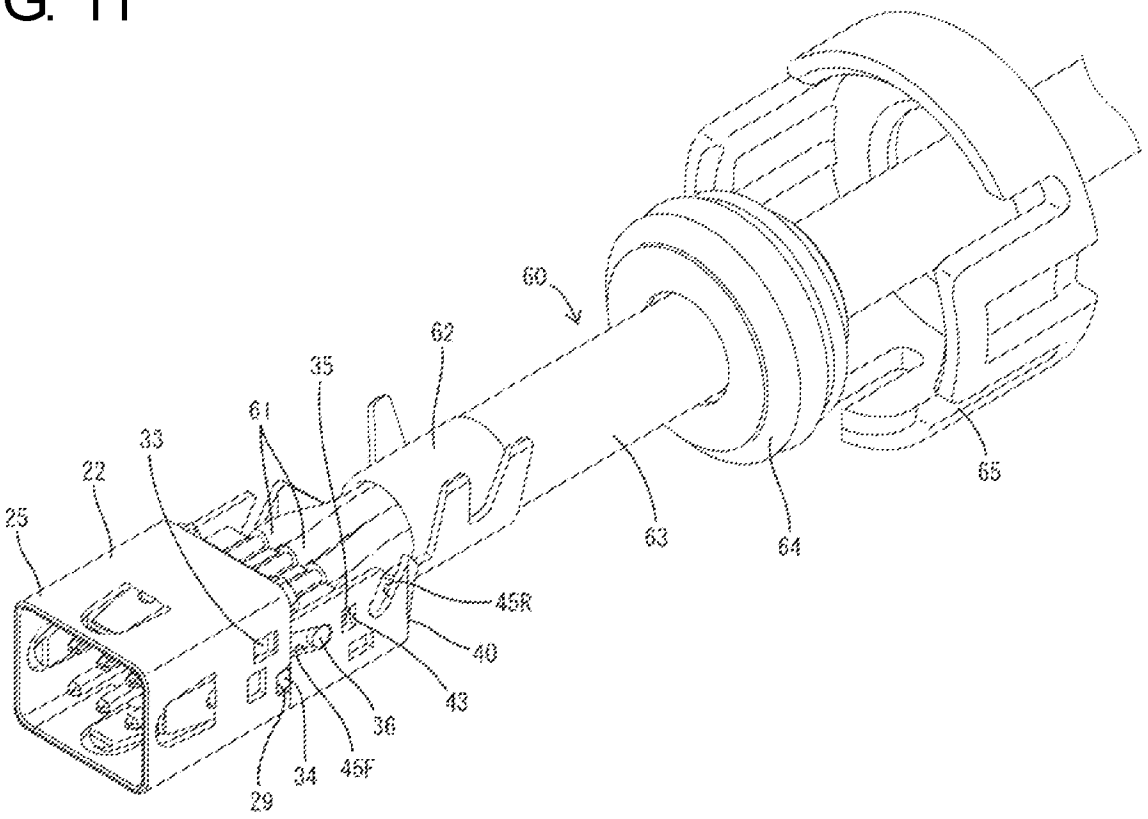
FIG. 11 is a perspective view showing a state where the lower member is assembled with the tubular member and the male dielectric.

As shown in FIG. 11, the lower member 40, the tubular member 22 and the male dielectric 31 are held in an assembled state by locking the fourth locking projections 35 with the fourth locking portions 43 and by fitting the first guide grooves 45F with the first guide pins 36. With the lower member 40 mounted on the tubular member 22 and the male dielectric 31, the crimping portion 46 covers a lower surface area of the outer periphery of the shield layer 62.

Figure 12:
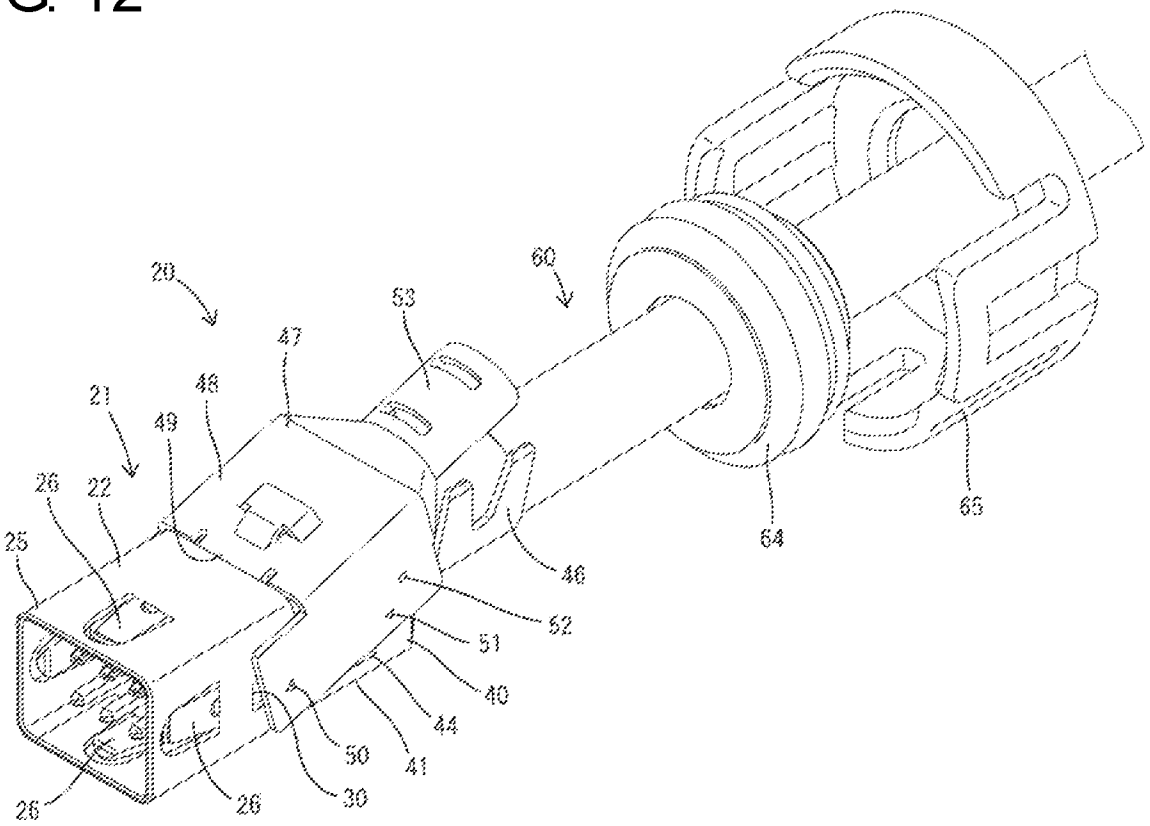
FIG. 12 is a perspective view showing a state where an upper member is being mounted on the tubular member and the lower member.

Thereafter, the upper member 47 is assembled with the tubular member 22, the male dielectric 31 and the lower member 40. In mounting, the second fulcrum 49 of the upper member 47 is locked to an upper edge part of the rear end of the holding portion 27 of the tubular member 22 and the upper member 47 is swung down with the locking position as a fulcrum, as shown in FIG. 12. In the process of swinging the upper member 47, the second guide grooves 45R and the second guide pins 52 slide against each other so that a swing trajectory of the upper member 47 is stabilized.

Figure 13:
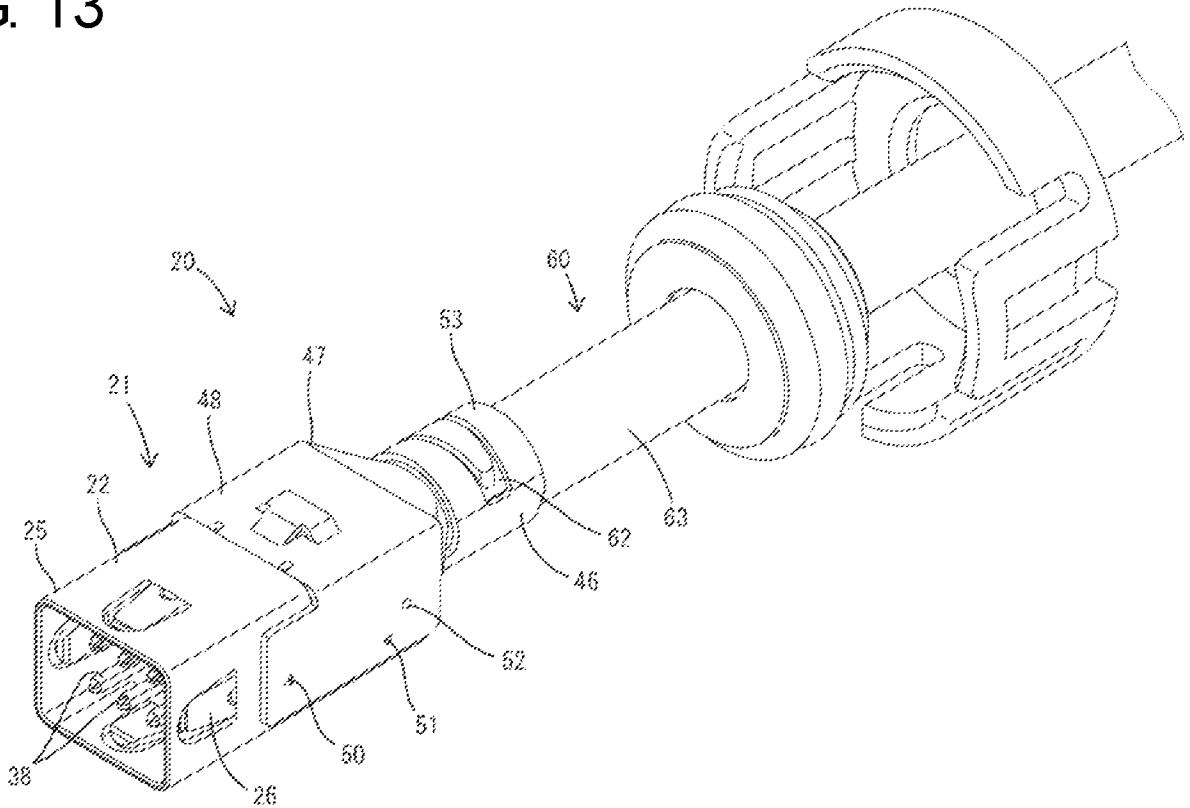
FIG. 13 is a perspective view showing a state where the assembling of the male shield terminal is completed.

The upper member 47, the tubular member 22 and the lower member 40 are held in an assembled state by: locking the third locking projections 50 with the third locking portions 30, locking of the fifth locking projections 51 with the fifth locking portions 44 and fitting the second guide grooves 45R with the second guide pins 52. With the upper member 47 mounted on the tubular member 22 and the lower member 40, the cover 53 covers an upper surface area of the outer periphery of the shield layer 62. Subsequently, as shown in FIG. 13, the crimping portion 46 is crimped to the outer periphery of the cover 53 so that the crimping portion 46 and the cover 53 are fixed conductively to surround the outer periphery of the shield layer 62 over the entire circumference, thereby completing the assembling of the male shield terminal 20.

Thereafter, the male shield terminal 20 is inserted into the male housing 10 from behind and is retained by the locking lance 13. A rubber plug 64 and a rear holder 65 externally fit on the multi-core cable 60 in advance then are mounted in a rear end part of the male housing 10 to complete the assembling of the male connector M.

Figure 2:
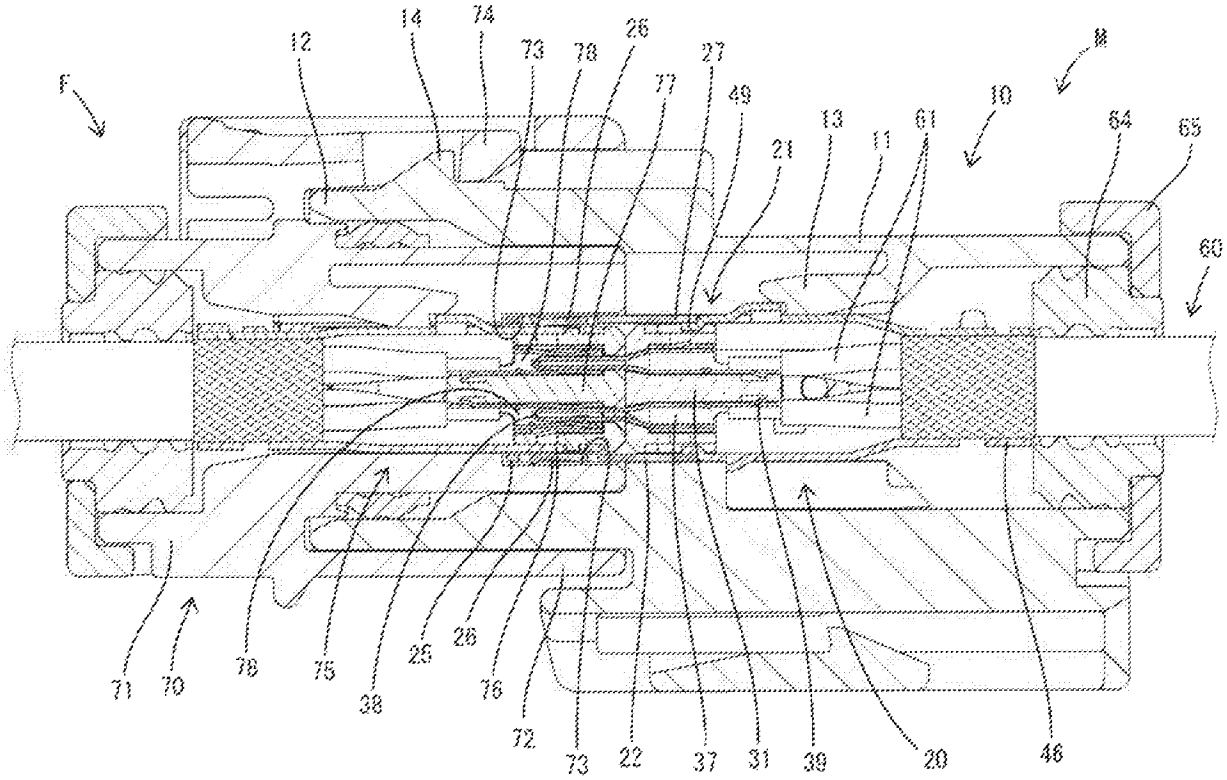
FIG. 2 is a side view in section showing a connected state of the male connector and the female connector.
Figure 3:
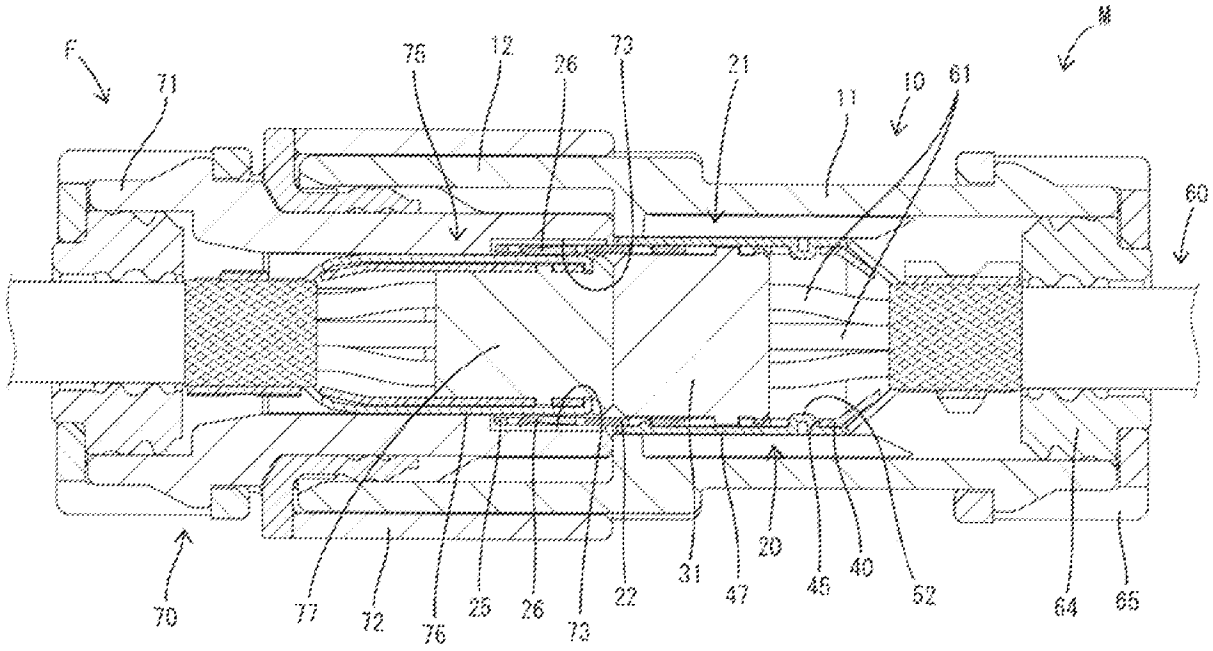
FIG. 3 is a plan view in section showing the connected state of the male connector and the female connector.

The female connector F includes a female housing 70 made of synthetic resin and a female shield terminal 75. As shown in FIGS. 2 and 3, the female housing 70 includes a housing body 71 for accommodating the female shield terminal 75 and a tubular fitting 72 for surrounding the housing body 71. The housing body 71 is formed with four contact surfaces 73 facing and at a short distance from a front part of the outer periphery of the female outer conductor 76. The tubular fitting 72 is formed with a lock arm 74. As shown in FIG. 2, the female shield terminal 75 includes the female outer conductor 76 substantially in the form of a rectangular tube, a female dielectric 77 accommodated in the female outer conductor 76 and female inner conductors 78 accommodated inside the female dielectric 77.

When the male connector M and the female connector F are connected, the housing body 71 is accommodated into the receptacle 12, the tubular fitting 72 surrounds the receptacle 12, and the connectors F, M are locked in a connected state by the locking of the lock arm 74 and the lock projection 14. With the connectors F, M connected, the tabs 38 of the male inner conductors 37 are connected to the female inner conductors 78 and the resilient contact pieces 26 of the male outer conductor 21 are resiliently in contact with the outer periphery of the female outer conductor 76.

Since the resilient contact pieces 26 are formed in the four plate parts constituting the tube 25, the resilient contact pieces 26 contact the outer periphery of the female outer conductor 76 in four upward, downward, leftward and rightward directions. Since the rear ends of the resilient contact pieces 26 are supported on the tube 25, radially outward (vertical direction and lateral direction) reaction forces act on the tube 25 due to resilient restoring forces of the resilient contact pieces 26 when the resilient contact pieces 26 resiliently contact the outer periphery of the female outer conductor 76.

However, the tube 25 is continuous over the entire periphery so as not be expanded and deformed by the fitting of the recess 23 and the protrusion 24. Thus, the tube 25 is retained in a desired substantially rectangular tube shape. Additionally, the inner peripheral surface of the tube 25 is not displaced away from the outer peripheral surface of the female outer conductor 76. Further, the four upper, lower, left and right surfaces constituting the outer periphery of the tube 25 are in contact with or proximately facing the four (upper, lower, left and right) contact surfaces 73 of the female housing 70. Therefore, even if the tube 25 is going to be expanded and deformed in the vertical or lateral direction, an expanding displacement is restricted by contact with the contact surfaces 73. In this way, contact pressures of the resilient contact pieces 26 with the female outer conductor 76 are ensured, and a reliable conductive connection of the male outer conductor 21 and the female outer conductor 76 is achieved.

As described above, the shield connector of this embodiment includes the male connector M and the female connector F. The male connector M includes the female housing 70, the female shield terminal 75 mounted in the female housing 70, the female inner conductors 78 constituting the female shield terminal 75 and the female outer conductor 76 surrounding the female inner conductors 78 via the female dielectric 77.

The female connector F includes the male housing 10 connectable to the female housing 70, the male shield terminal 20 mounted in the male housing 10, the male inner conductors 37 constituting the male shield terminal 20 and to be connected to the female inner conductors 78 by connecting the female housing 70 and the male housing 10, and the male outer conductor 21 surrounding the male inner conductors 37 via the male dielectric 31 and configured to contact the female outer conductor 76 by connecting the female housing 70 and the male housing 10.

The male outer conductor 21 is formed with the tube 25 surrounding the female outer conductor 76 with the female housing 70 and the male housing 10 connected. Additionally, the tubular member 22 of the male outer conductor 21 is formed with the resilient contact pieces 26 configured to resiliently connect the outer periphery of the female outer conductor 76 and the inner periphery of the tube 25. The tube 25 is formed to be continuous over the entire periphery, thereby restricting an expanding deformation thereof.

With the outer periphery of the female outer conductor 76 and the tube 25 of the male outer conductor 21 connected by the resilient contact pieces 26, resilient forces of the resilient contact pieces 26 act in directions to expand and deform the tube 25. However, the tube 25 is continuous over the entire periphery to restrict the expanding deformation, so that contact reliability between the female outer conductor 76 and the male outer conductor 21 is excellent.

In addition, the female housing 70 is formed with the contact surfaces 73 that are contacted by the outer peripheral surface of the tube 25 when the female housing 70 and the male housing 10 are connected. According to this configuration, expanding deformation of the tube 25 also is restricted by the contact surfaces 73 of the female housing 70 with the female housing 70 and the male housing 10 connected. Thus, the contact reliability of the female outer conductor 76 and the male outer conductor 21 is improved.

Further, the male outer conductor 21 may include the tubular member 22 formed with the tube 25 and the lower member 40 (crimping member) formed with the crimping portion 46 to be crimped to the shield layer 62 of the multi-core cable 60. According to this configuration, the complexly configured crimping portion 46 is formed on the lower member 40 separate from the tubular member 22. Thus, the shape of the tubular member 22 can be simplified. In this way, a function of restricting the expanding deformation of the tube 25 can be prioritized in designing the tubular member 22, and an expanding deformation of the tube 25 can be prevented.

Further, the tube 25 surrounds the tabs 38 of the male inner conductors 37. Thus, the tube 25 prevents external matter from interfering with the tabs 38 when the male shield terminal 20 detached from the male housing 10.

The invention is not limited to the above described and illustrated embodiment. For example, the following embodiments also are included in the scope of the invention.

Although the resilient contact pieces are formed only in the tube portion of the male outer conductor in the above embodiment, the resilient contact pieces may be formed in both the tube portion and the female outer conductor or may be formed only in the female outer conductor.

Although the tube portion surrounds the tabs in the above embodiment, front end parts of the tabs may project further than the front end of the tube portion.

Although the male outer conductor is composed of three components, i.e. the tubular member, the lower member and the upper member in the above embodiment, the male outer conductor may be composed of two or less or four or more components.

Although the female housing is formed with the contact surfaces, with which the outer peripheral surface of the tube portion is brought into contact, in the above embodiment, the female housing may include no contact surface.

LIST OF REFERENCE SIGNS

10 male housing
20 male shield terminal
21 male outer conductor
22 tubular member
25 tube
26 resilient contact piece
31 male dielectric
37 male inner conductor
38 tab
40 lower member (crimping member)
46 crimping portion
60 multi-core cable (cable)
62 shield layer
70 female housing
73 contact surface
75 female shield terminal
76 female outer conductor
78 female inner conductor

The invention claimed is:

1. A shield connector, comprising:
a female housing;
a female shield terminal mounted in the female housing;
a female inner conductor constituting the female shield terminal;
a female outer conductor surrounding the female inner conductor via a female dielectric;
a male housing connectable to the female housing;
a male shield terminal mounted in the male housing;
a male inner conductor constituting the male shield terminal, the male inner conductor being connected to the female inner conductor by connecting the female housing and the male housing;
a male outer conductor surrounding the male inner conductor via a male dielectric, the male outer conductor contacting the female outer conductor by connecting the female housing and the male housing;
a tubular member constituting the male outer conductor;
a crimping member constituting the male outer conductor, the crimping member being a component separate from the tubular member, the crimping member being formed with a crimping portion to be crimped to a shield layer of a cable;
a tube formed in the tubular member, the tube surrounding the female outer conductor with the female housing and the male housing connected; and
a resilient contact piece formed in at least one of the female outer conductor and the male outer conductor, the resilient contact piece resiliently connecting an outer periphery of the female outer conductor and an inner periphery of the tube;
the tube being continuous over an entire periphery, thereby restricting an expanding deformation thereof.

2. The shield connector of claim 1, wherein the tube surrounds a tab of the male inner conductor.

3. The shield connector of claim 2, wherein the female housing is formed with a contact surface with which an outer peripheral surface of the tube is brought into contact with the female housing and the male housing connected.

4. A male shield terminal to be mounted into a male housing connectable to a female housing, comprising:
a male inner conductor connectable to a female inner conductor provided in the female housing;
a male outer conductor surrounding the male inner conductor via a male dielectric, the male outer conductor being capable of contacting a female outer conductor provided in the female housing;
a tubular member constituting the male outer conductor;
a crimping member constituting the male outer conductor, the crimping member being a component separate from the tubular member, the crimping member being formed with a crimping portion to be crimped to a shield layer of a cable;

a tube formed in the tubular member, the tube surrounding the female outer conductor with the female housing and the male housing connected; and a resilient contact piece formed in the tube, the resilient contact piece being resiliently connected to an outer periphery of the female outer conductor;

the tube being continuous over an entire periphery, thereby restricting an expanding deformation thereof.

* * * * *